US005236157A

United States Patent [19]

Reggiani

[11] Patent Number: 5,236,157

[45] Date of Patent: Aug. 17, 1993

[54] DEVICE FOR FASTENING A CASING IN A CAVITY, IN PARTICULAR FOR SECURING RECESSED FIXTURES IN PANELLING

[75] Inventor: Fabio Reggiani, Milan, Italy

[73] Assignee: Reggiani, S.p.A. Illuminazione, Milan, Italy

[21] Appl. No.: 920,042

[22] Filed: Jul. 27, 1992

[30] Foreign Application Priority Data

Aug. 2, 1991 [IT] Italy ..... MI 91 A 002176

[51] Int. Cl.[5] ..... G12B 9/00

[52] U.S. Cl. ..... 248/27.1; 248/906; 362/366

[58] Field of Search ..... 248/27.1, 906; 362/365, 362/366, 147, 370, 371; 361/356

[56] References Cited

U.S. PATENT DOCUMENTS

| | | | |
|---|---|---|---|
| 2,635,778 | 4/1953 | Dieffenderfer | 248/27.1 X |
| 2,762,591 | 9/1956 | Weber | 248/27.1 |
| 3,710,096 | 1/1973 | McFarlin | 248/27.1 X |
| 3,963,204 | 6/1976 | Liss | 220/3.9 |
| 4,293,895 | 10/1981 | Kristofek | 362/147 |
| 4,733,339 | 3/1988 | Kelsall | 362/366 |
| 4,739,460 | 4/1988 | Kelsall | 362/365 |
| 4,816,966 | 3/1989 | Frankowski | 361/356 |

*Primary Examiner*—J. Franklin Foss

*Attorney, Agent, or Firm*—Shlesinger, Fitzsimmons & Shlesinger

[57] ABSTRACT

A fastening device (10) for securing a recessed casing in a cavity in a surface, comprises a guide (11) along which runs a slider (12) with a front engaging end (29). The slider (12) has unidirectional coupling means (19, 20) which engage with the guide (11). The slider (12) is also provided, towards the front end (29), with a cam surface (28) acting on the guide (11) in slots (21, 22) to increase the distance of the front end (29) of the slider (12) from the guide (11) when it is made to slide along the guide by manual shifting means (15). In this way, the front end (29) is brought into contact with the surface of the cavity and the slider (12) engages with the guide (11) by means of the unidirectional coupling means (19, 20).

12 Claims, 3 Drawing Sheets

DEVICE FOR FASTENING A CASING IN A CAVITY, IN PARTICULAR FOR SECURING RECESSED FIXTURES IN PANELLING

This invention refers to an innovative fastening device for securing a recessed fixture in a cavity in a surface, such as panelling. For example, said device is suitable for securing in position lighting fixtures such as flush-mounted spotlights in double ceilings or the like.

Known fasteners have been proposed in which the fixture is secured directly by means of screws or by operating clamping jaws. These types of fasteners, however, take a relatively long time to fit and are therefore particularly awkward to use in double ceilings. Quick coupling devices have been proposed comprising flat springs which bend to enable them to be inserted into the cavity designed to receive the fixture and then open out "umbrella-fashion" to hold the fixture in place.

Fasteners of this kind, however, present numerous disadvantages, one of the most significant being the fact that their accurate fastening depends very closely upon the thickness of the panelling. In fact, the degree of pressure exerted by the flat springs against the panel is due to their flexure which depends upon the thickness of the panel itself and is consequently not adjustable. It can therefore occur that the flat springs exert excessive pressure on the panel, which is liable to damage particularly delicate panels such as double ceilings made of plaster. Moreover, an excessively thin panel would not stress the springs enough to keep the fixture adhering closely to the panel itself. Conversely, an excessively thick panel would not allow the springs to reopen after the fixture has been introduced into the cavity.

A further problem is that, in order to remove the recessed fixture, it is necessary to at least partially disassemble it to be able to reach the springs in order to bend them so that the casing of the fixture can be pulled out.

Various other known devices have been proposed but have proved to be unsatisfactory. For example, a device was proposed in which lateral tongues hinged at one end are made to open outwards in a radial direction by means of cam surfaces disposed on a rotating collar. Thus, when the fixture is inserted the collar is rotated to open the tongues and lock the fixture in place. With this device the amount of pressure on the tongues can be adjusted to a certain degree by varying the rotation of the control collar. However, the mechanism is complex and, therefore, expensive and the collar must be placed externally, which gives rise to aesthetical problems. Moreover, the entire fixture must be designed taking into consideration the control mechanism, which occupies a considerable amount of space. Consequently, the mechanism cannot easily be adapted to a previously existing range of fixtures.

The general scope of this invention is to obviate the aforementioned problems by providing a fastening device for securing recessed fixtures in position, which is structurally simple, inexpensive, of small overall dimensions and quick to fit, while at the same time adapting to wide variations in the thickness of the panelling and enabling adjustment of the gripping pressure.

This scope is achieved according to the invention by providing a fastening device for securing a recessed fixture in a cavity in a surface, comprising a guide substantially parallel to the axis of the cavity, along which runs a slider extending in the direction of the guide so as to have its front engaging end close to the cavity, the slider having unidirectional coupling means to couple it to the guide and, towards the front end, a cam surface acting upon the guide to increase the distance of the front end of the slider from the guide when the slider is made to run along the guide towards the cavity by manual shifting means, in order to bring the front end into contact with the surface and engage the guide by means of the unidirectional coupling means.

The innovatory principles of this invention and its advantages compared to the known technique will be more clearly evident from the following description of a possible exemplificative embodiment applying such principles, with reference to the accompanying drawings, in which.

Figure 1:
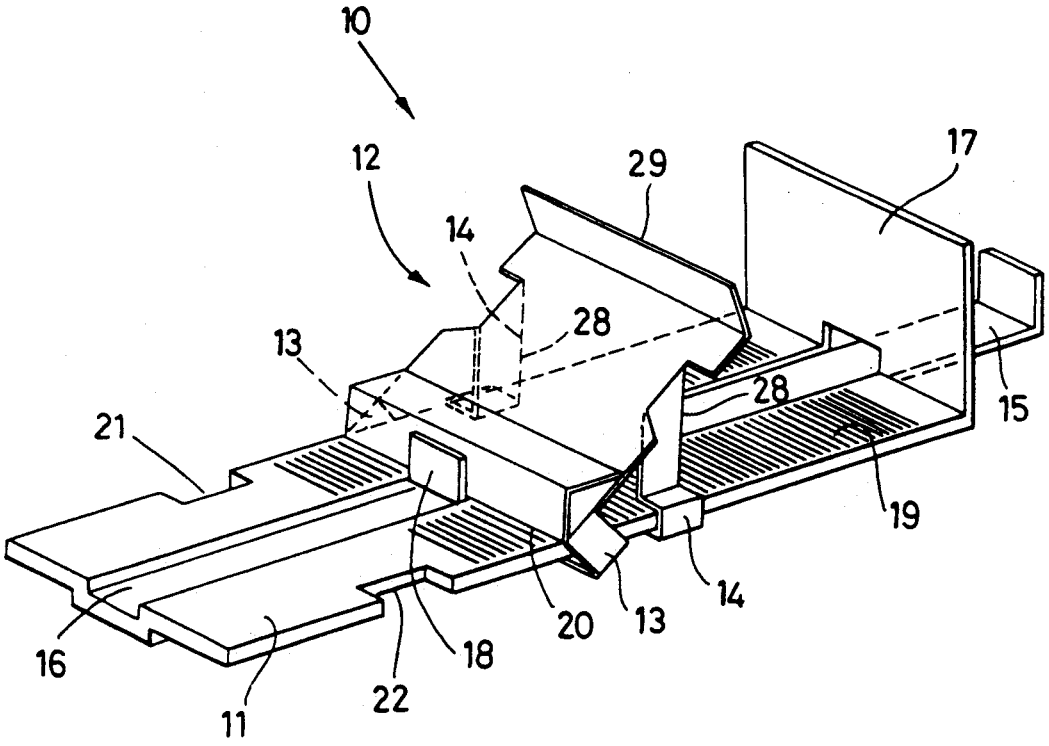
FIG. 1 shows a schematic perspective view of a fastening device according to the invention.

With reference to the figures, FIG. 1 shows a fastening device, generically indicated by reference 10, made according to the innovatory principles claimed herein.

Said device 10 comprises a guide plate 11 along which runs a slider 12 by means of rear arms 13 with U-shaped ends and front guiding tongues or arms 14 which grip the edge of the plate 11.

A pull-out element 15 slides within a groove 16 to intercept the slider, by means of a bent end 18, and cause it to move towards a counter plate 17 at one end of the guide 11.

The surface of the guide along which the slider 12 runs has transversal notches or ribs 19 which engage, as will be explained further on, with a rear edge 20 of the slider. The guide is also provided with two lateral slots 21 and 22 for the guided passage of the arms 14 as is described further on.

Figure 2:
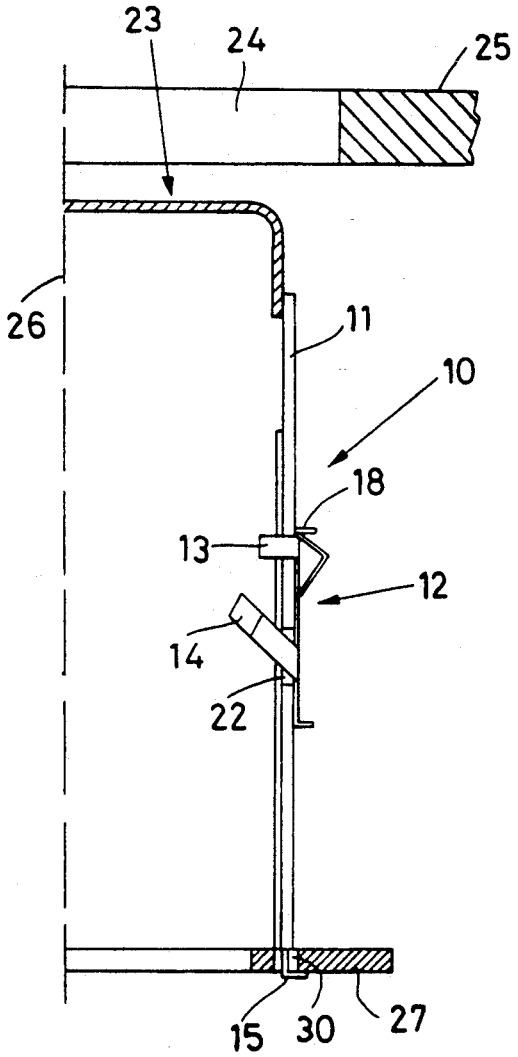
FIG. 2 shows a schematic partial cutaway side view of a recessed fixture employing the device of FIG. 1.
Figure 3:
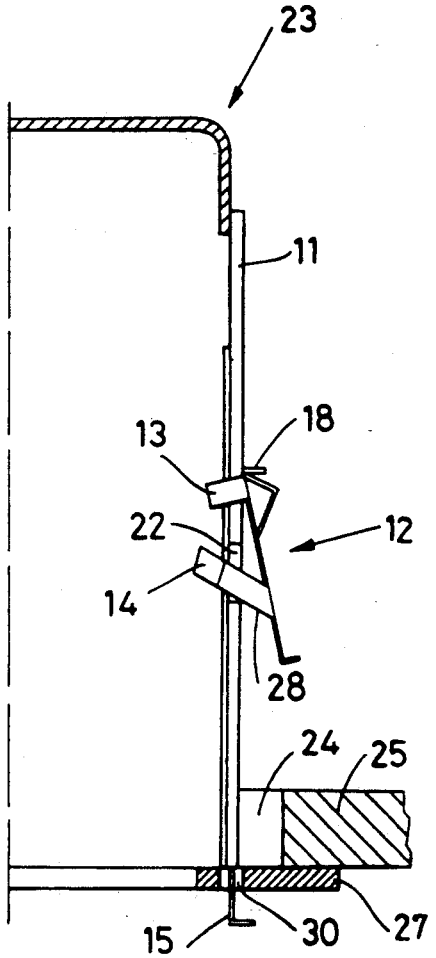
FIG. 3 shows a view similar to FIG. 2 but with the device in an intermediate operative position.
Figure 4:
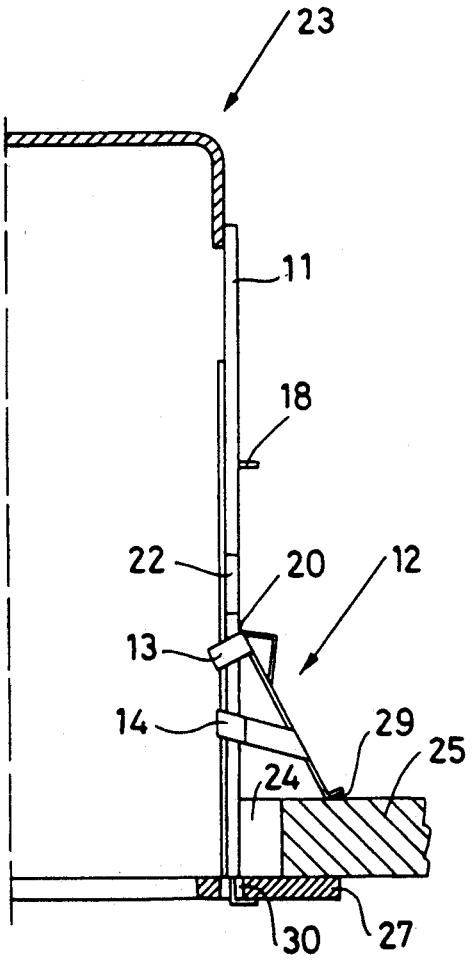
FIG. 4 shows a view similar to FIG. 2 but with the device in a final gripping position.

By way of example, FIGS. 2–4 show the device of FIG. 1 applied to an apparatus 23 to be recessed in a cavity 24 in a panel 25. For example, the apparatus 23 can be a light fixture. The fixture will be provided externally with a plurality of fastening devices 10 (for example, two in diametrically opposite positions) only one of which is shown since it is easy to imagine the complete fixture which , moreover is of known technique, for example symmetric with regard to the line 26.

Hereinafter, the movement of only one device 10 will be described since it is obviously the same for each device applied to the fixture.

FIG. 2 shows the fixture with the fastening device in the position for insertion into the panelling 25. In this position, the slider 12 is moved away from the counter plate 17 (in this case represented by an outer edge 27 of the fixture 23) so that the arms 14 fit into the lateral slots 21, 22 and the slider can lie with its surface parallel to the guide 11. In this way, the lateral dimensions of the slider are minimal and the fixture can easily be inserted into the cavity 24 until the edge 27 comes into contact with the surface of the panel 25.

Once the fixture has been fitted in position the pull-out element 15 is pulled so that its end 18 begins to draw the slider along the guide 11. As can be seen in FIG. 3, this causes the front edge 28 of the arms to slide cam-fashion along the corresponding edge of the slots 21, 22 so that the slider is forced to rotate outwards around its rear edge 20.

By continuing to exert traction on the pull-out element 15, the U-shaped ends of the arms 14 engage the edges of the guide and then the slider begins to slide parallel to the guide in an extended position similar to that of FIG. 1, until it comes to rest with its front end 29 in contact with the internal surface of the panelling, as shown in FIG. 4. In this position the slider becomes wedged between the surface of the panel and the notches 19 on the guide, which constitute unidirectional coupling means, so as to be firmly locked in position. It is evident that the pressure that the slider exerts on the panel depends upon the force with which the pull-out element 15 is pulled. When the desired adherence between the edge of the fixture and the panel is achieved the pull-out element 15 can be pushed back into the groove 16, and the fastening operation can be considered completed. The front end of the slider 12 can be advantageously made flexible so as to bend slightly on contact with the surface 25 and thus ensure adherence of the fixture to the cavity.

The fixture can be disengaged from the panel by simply inserting an elongated tool, such as a screwdriver, in the slot 30 in which the pull-out element 15 passes through the edge 27, so as to reach the rear portion 20 of the slider and lift it from the coupling surface 19 thereby enabling it to move backwards.

Figure 5:
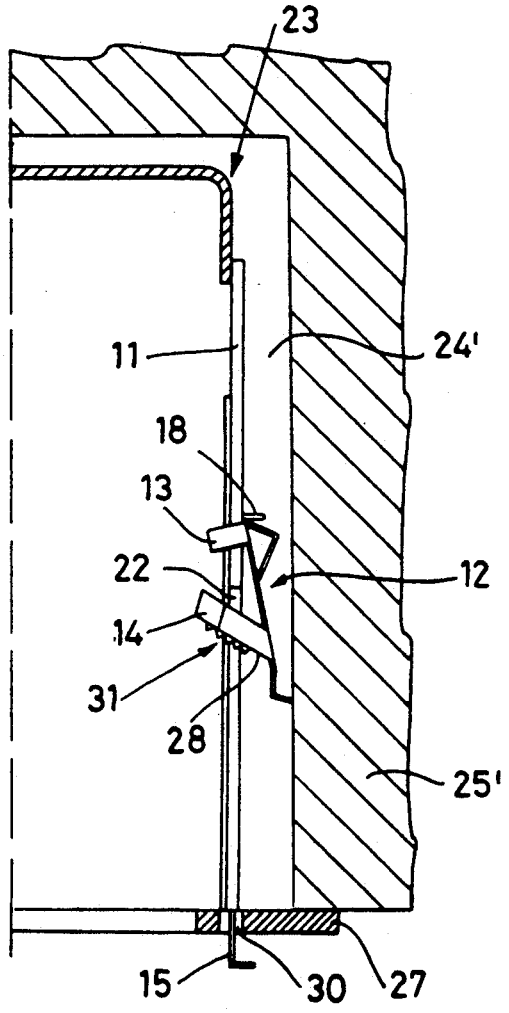
FIG. 5 shows a cutaway side view of a different embodiment of the device.

FIG. 5 shows an operative variation of the device of FIG. 1. In this variation, the fixture to be secured is flush-mounted in a solid wall 25' and the receiving cavity 24' consequently extends along the lateral wall of the fixture. In this case, the free end of the slider acts on the wall of the cavity. Even though the flexibility of the slider enables the arms 14 to grip the lateral edges of the guide, they can also engage the latter in an intermediate position, as shown in FIG. 5. In this case, the arms 14 can advantageously be provided with intermediate toothing 31.

At this point it will be obvious that the intend scopes have been achieved. A fastening device according to the invention which enables fixtures to be accurately secured, with adjustable gripping strength, and with a wide variety of panel thicknesses ranging from practically zero to the maximum length of the guide 11 from the slots 21, 22 to the counter plate 17. By suitably dimensioning the device it is possible for example to secure a fixture to which it is applied, also in panels almost as thick as the height of the fixture itself. If necessary, by making the end 29 of the slider suitably flexible a device 10 can also be used for securing a fixture by pressure of the slider against the side wall of the cavity instead of against the edge of the panelling.

The device can always be easily released from the outside and its shape and dimensions do not affect the shape of the fixture to which it is applied. The guide 11 can obviously be either a separate element secured to the side of the fixture by means of screws, joints or welding, or made in one piece with the side of the fixture.

The foregoing description of an embodiment applying the innovatory principles of this invention is obviously given by way of example in order to illustrate such innovatory principles and should not therefore be understood as a limitation to the sphere of the invention claimed herein. For example, the slider, which is advantageously pressed and shaped from sheet metal, can differ in shape from the one shown also in order to give it further or different guiding or unidirectional coupling means along the guide 11. Different means can also be used to manually shift the slider. For example, instead of being made in the form of a rigid metal strip, the pull-out element 15 can also be made in the form of a flexible element such as a cable or as an element to be torn off once the fixture has been secured in position.

Lastly, as mentioned previously, even though the device is particularly suitable for application in the manufacture of recessed light fixtures, such application should not be understood as restrictive since other advantageous applications can be easily envisaged by the technician.

I claim:

1. A fastening device for securing a recessed fixture in a cavity in a surface, comprising an elongate guide on said fixture disposed to extend substantially parallel to the axis of the cavity, a slider separate from and manually slidable in opposite directions on said guide in a path extending in the longitudinal direction of the guide and having a front end movable toward and away from said guide and an adjacent wall of the cavity, the slider having unidirectional coupling means engagable with said guide to couple it to the guide and having thereon, adjacent said front end thereof, a cam surface acting upon the guide to increase the distance of the front end of the slider from the guide when the slider is made to slide along the guide towards the surface containing said cavity, in order to bring said front end into fastening contact with said adjacent wall of the cavity, and to engage the guide with the unidirectional coupling means.

2. Device as claimed in claim 1, characterized by the fact that the slider comprises guiding means adjacent said front end thereof which slide along the guide, when the front end is spaced a pre-established distance from the guide, to enable the slide to slide along the guide with said front end spaced said pre-established distance from said guide.

3. Device as claimed in claim 2, characterized by the fact that integrally connected to the guide is a counter plate which rests on the outer side of said wall of the cavity, the contact between the front end of said slider and said wall being at the inner side of said wall of the cavity, in order to grip the wall between the counter plate and the front end of the slider.

4. Device as claimed in claim 1, characterized by the fact that contact between the front end of said slider and the wall of said cavity takes place inside the cavity, said cam surface causing said front end of said slider to press radially against said cavity wall.

5. Device as claimed in claim 2, characterized by the fact that the cam surface is composed of arms protruding from the slider towards the guide which slide frontally on reaction edges made in the guide and the slider guiding means are provided at the free ends of said arms.

6. Device as claimed in claim 1, characterized by the fact that the slider is slidable manually by a pull-out element which engages with the slider and has an operating end protruding anteriorly from the cavity.

7. Device as claimed in claim 6, characterized by the fact that the pull-out element is rigid and slides in a groove in the guide to engage its rear end protruding from the groove with the rear end of the slider.

8. Device as claimed in claim 5, characterized by the fact that said reaction edges are transversal front edges of lateral grooves in the guide.

9. Device as claimed in claim 5, characterized by the fact that the arms are two in number, one on each side of the slider and the guiding means are generically C-shaped to grip corresponding lateral edges of the guide.

10. Device as claimed in claim 1, characterized by the fact that at its rear end the slider laterally comprises two arms which slidingly grip corresponding lateral edges of the guide.

11. Device as claimed in claim 1, characterized by the fact that the unidirectional coupling means on the guide comprise projecting ridges formed crosswise to its extension between which one edge of the rear end of the slider engages when the front end thereof comes to rest on the surface.

12. Device as claimed in claim 1, characterized by the fact of there being two of said devices fitted in at least two diametrically opposing positions on the recessed fixture.

* * * * *